United States Patent [19]

Campbell

[11] 4,368,800

[45] Jan. 18, 1983

[54] SCAFFOLDING APPARATUS

[76] Inventor: Robert L. Campbell, P.O. Box 691, Big Bar, Calif. 96010

[21] Appl. No.: 887,027

[22] Filed: Mar. 16, 1978

[51] Int. Cl.[3] ..... E04G 3/10; E04G 5/08

[52] U.S. Cl. ..... 182/82; 182/133; 182/142; 182/187; 248/217.1; 248/217.3; 248/218.4; 248/235

[58] Field of Search ..... 182/145, 146, 142, 133, 182/134, 82; 248/216.1, 217.1, 217.3, 218.4, 222.1, 225.3, 225.4, 226.5, 228, 235, 245, 291, 240.4, 242

[56] References Cited

U.S. PATENT DOCUMENTS

| | | | |
|---|---|---|---|
| 1,260,856 | 3/1918 | Bates | 182/134 |
| 2,605,074 | 7/1952 | Bucsko | 248/225.3 |
| 3,148,857 | 9/1964 | Hutchison | 182/187 |
| 3,198,470 | 8/1965 | Owens | 248/245 |
| 3,292,734 | 12/1966 | Swanberg | 182/45 |
| 3,877,543 | 4/1975 | Iwata | 182/133 |
| 4,078,633 | 3/1978 | Fahy | 182/145 |

*Primary Examiner*—Reinaldo P. Machado
*Attorney, Agent, or Firm*—Bielen and Peterson

[57] ABSTRACT

A scaffold apparatus usable in conjunction with conventional on-site building materials to provide an adjustable scaffold, the scaffold apparatus having a matched pair of plank brackets with a releasable clamping mechanism adapted to clamp the brackets to a pair of spaced timber posts, the plank brackets having cantilevered arm portions extending from the post on which a horizontal cross plank is supported, the brackets having an adjustment mechanism cooperating with a cable for raising and lowering the brackets and cross plank on the timber posts, the plank brackets in combination with additional hardware for supporting and bracing the timber posts forming a compact scaffolding kit.

17 Claims, 9 Drawing Figures

SCAFFOLDING APPARATUS

BACKGROUND OF THE INVENTION

This invention relates to scaffolding and in particular to hardware for quickly erecting an adjustable scaffold using common building site materials. The scaffold apparatus is compact and lightweight and may be conveniently stored by a workman in an easily portable box in kit form.

The building trades have long sought a means for quickly constructing a light, safe and versatile scaffold that was substantially independant of the face of a building for its support. Formerly, scaffolding that was designed for either limited contact with a building or independently supported was either too cumbersome, or limited in application.

Conventional timber scaffolding relies upon a timber frame having spaced pairs of vertical posts providing a four point ground support, horizontal longitudinal ledgers, and horizontal transverse members. The planks upon which the workmen stand are supported by the transverse cross members. Longitudinal and transverse cross bracing is provided to stabilize the structure. This type of scaffolding utilizes a substantial amount of timber, is space consuming, and is fixed in height requiring reassembly or multiple ledgers and transverse members for variations in height.

Trestle supports have been devised to provide some adjustment in height. The horizontal members which support the platform planks span pairs of vertical column members which are adjustably supported in pairs of A-frames. However, the height to which the vertical column members may be raised is limited, becoming unstable at much of the height necessary in construction of even moderately-sized buildings.

Tubular scaffolding has become popular for use in much of modern construction. The scaffolding is modular in construction for raising to exceptional heights and has a basic configuration similar to timber scaffolding. Members are tubular in form and designed to provide staging in height increments by a socket attachment of standard end frames into the top ends of identical end frames. Spaced pairs of end frames are interconnected by easily connected cross bracing. Tubular scaffolding is effective but requires a large investment and is bulky, requiring a substantial storage capability. It is inconvenient for many job sites where the available space for scaffolding is limited and is often too much of a problem to obtain and erect for minor and moderate construction projects.

Suspended scaffolding comprises a pair of horizontal putlogs that support the plank members. The putlogs are suspended by cables attached to overhead outrigger beams. The putlogs are generally equipped with two drum mechanisms having ratchet devices which act as winches to raise and lower the putlogs and plank members. While relatively compact for storage, the scaffolding lacks the stability needed for many construction tasks.

The disadvantages of conventional scaffold devices have been obviated by the scaffolding apparatus described hereinafter, which has been devised to provide a stable support for a working platform which is easily and conveniently erected and which is easily stored and transported to and from the jobsite and is suitable for inclusion in the working tool kit of even the individual tradesman.

SUMMARY OF THE INVENTION

The scaffold apparatus of this invention comprises a set of hardware having as its principal components a pair of support brackets which provide a cantilever support for a working plank. The support brackets or plank brackets are attachable to a conventional timber preferably comprising a common two by six framing plank.

Hardware for erecting and supporting the timber is attached to the timber before raising the timber to a vertical post position adjacent to but dispaced from the building. A collar slideable on the end of each of the two necessary timbers includes a plate for attachment to a convenient upper portion of the building to maintain the timber in a vertical position. A brace socket is attached to opposite faces of the timber and hingedly retains the end of a two by four cross brace segment near the upper end of each timber. After raising the timbers, the braces can be connected to opposite brace segments attached to the lower end of the timbers.

Each support bracket has an elongated horizontal cantilever leg upon which the workman's plank is supported. On the bracket at the base of the cantilever leg is a bearing heel. Directed generally opposite from the cantilever leg is a lag foot with a bearing roller mounted at its distal end or toe. The bearing heel and bearing roller contact, respectively, the fore and aft edges of the vertical timber in bracketing fashion. The lag foot is angled upward from the horizontal providing a cant to the two bearing points such that weight upon the leg of the bracket torsionally locks the bracket on the timber.

A spring loaded clamping mechanism having a displaceable contact surface is drawn directly opposite the cantilever leg and bearing heel such that the contact surface is cocked against the aft edge of the timber on a compression line with the bearing heel. Ears on the bearing heel, the distal end of the lag foot and the clamping mechanism prevent the bracket from disengaging from the timber.

A cable extending to the top of a building is connected to the support bracket in such a manner that pulling on the cable unlocks the clamping mechanism and allows the bracket to be raised, guided by the bearing roller and bearing heel. The bearing roller has a freewheel mechanism to roll in one direction and the bearing heel is canted to bite into the timber in the downward direction such that the bracket is easily raised, but unable to inadvertently fall when an upward lift ceases.

To lower the bracket, the vertical direction of the cable from the point of engagement with the bracket is changed by a line segment from the distal end of the cantilever leg which connects to the cable. This provides a bifurcated support which alter the line of lift causing a tilt to the bracket along with the uncocking of the clamping mechanism. The bearing roller is removed from contact with the timber and the bearing heel becomes flush with the timber edge allowing the bracket to be lowered.

Raising or lowering the two brackets and the working plank can be accomplished simultaneously or alternately.

BRIEF DESCRIPTION OF THE DRAWINGS

FIG. 4(*b*) is a cross sectional view as in FIG. 4(*a*) with clamping mechanism engaged.

DETAILED DESCRIPTION OF THE PREFERRED EMBODIMENT

Figures 1, 3, 5:
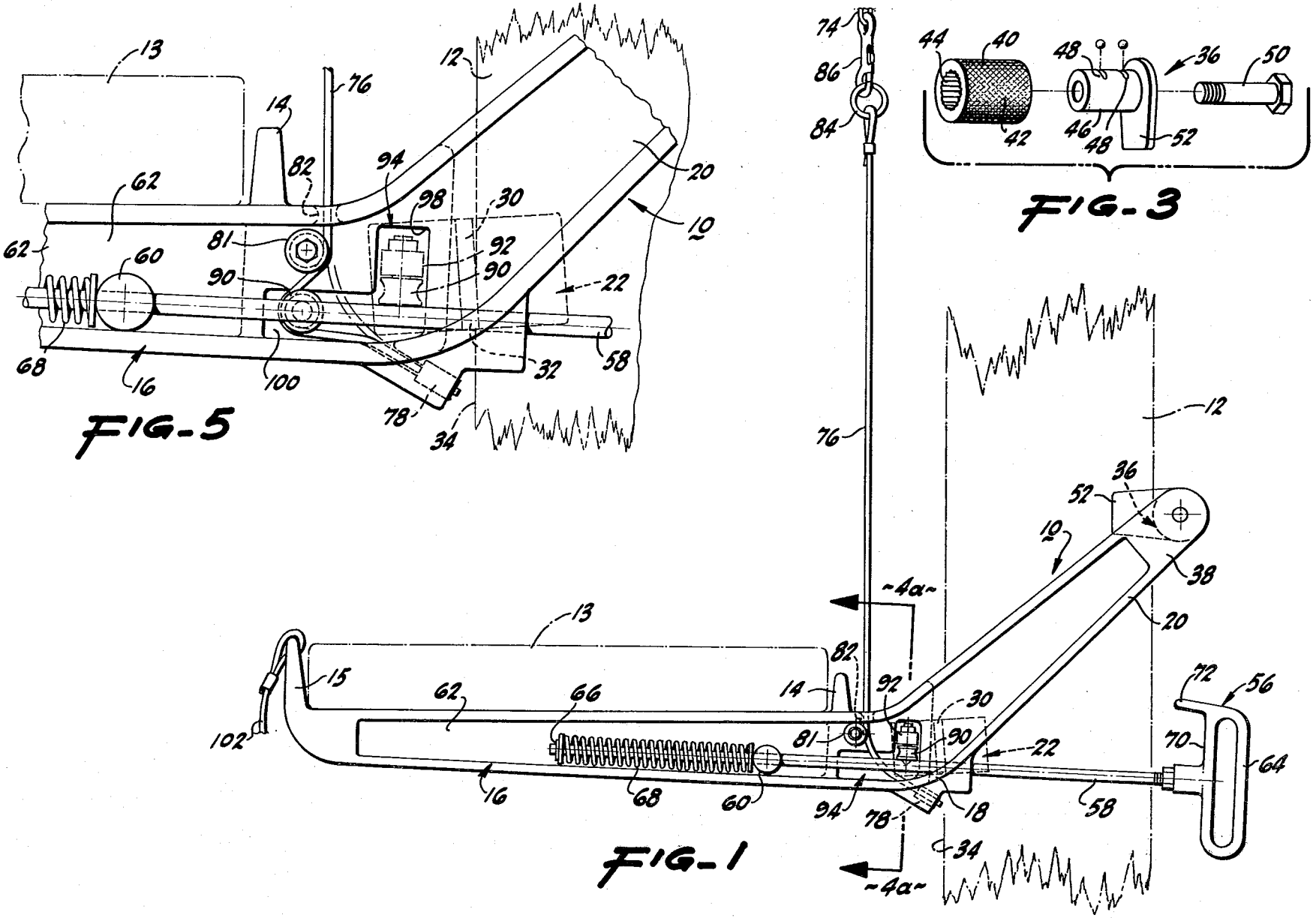
FIG. 1 is a side elevational view of one of the plank brackets of the scaffold apparatus.
FIG. 3 is an exploded view of the roller assembly.
FIG. 5 is a partial fragmentary view with clamping mechanism engaged.
Figure 2:
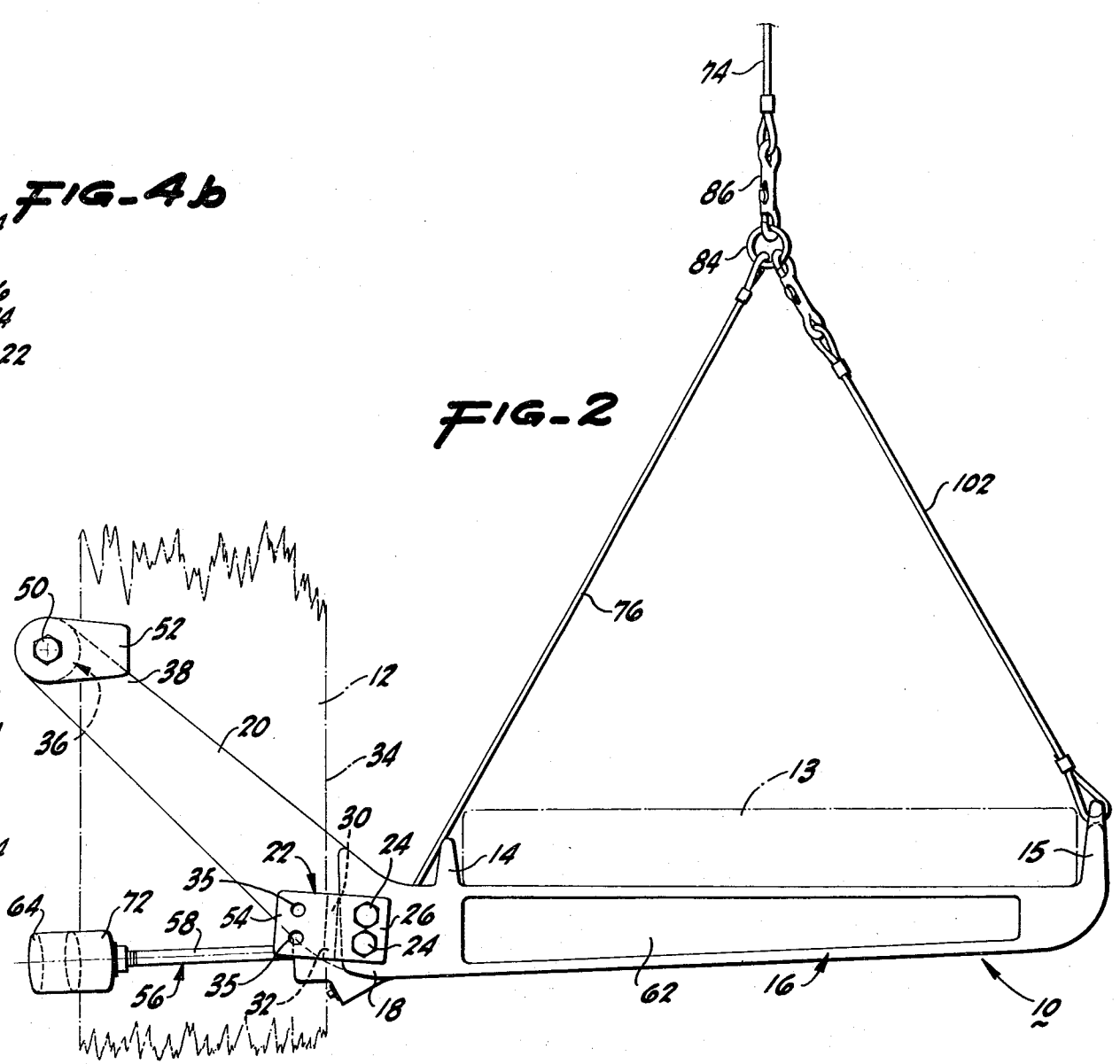
FIG. 2 is a side elevational view of the opposite side of the plank bracket of FIG. 1 with clamping mechanism engaged.

Referring to FIGS. 1 and 2, the principal element of the scaffold apparatus, a plank bracket 10 is shown. The plank bracket 10 is arranged with a mirror image plank bracket in a parallel spaced orientation on vertical support timbers 12, one of which is shown in phanton in FIGS. 1 and 2. The pair of plank brackets support a horizontal plank 13 here shown in phantom in a preferred embodiment as a lightweight, elongated banana board conventionally used as a working platform adjacent a structure under construction. The plank 13 is set between two bracketing stops 14 and 15 for stability.

The plank bracket 10 is fabricated from an aluminum casting in a generally I-configured cross section having an elongated cantilever leg 16 projecting horizontally from a base portion 18. Oppositely projecting at an upward angle from the cantilever leg 16 is a lag foot 20 which is integral to the casting of the leg 16 and base portion 18.

Referring to FIG. 2, the base portion 18 of the plank bracket includes a bearing heel 22 which is attached to the base portion 18 by bolts 24. The bearing heel 22 comprises a hardened steel T-section having a mounting face 26 oriented in a specific manner by two threaded locating holes 28 in the base portion of the bracket. The T-section bearing face 30 shown in dotted line is perpendicular to the mounting face 26 and oriented at approximately a four degree angle from the perpendicular by the locating holes 28 such that the lower outer edge 32 is biased toward the support timber 12. This slight cant allows the edge 32 to "bite" into the side edge 34 of the timber to prevent slippage of the plank bracket. The T-section is symmetrical and includes auxilliary mounting holes 35 to allow the T-section to be reversed if the original biting edge becomes worn.

A bearing roller 36 at the distal end or toe 38 of the lag foot 20 operates in conjunction with the bearing heel 22 to locate the plank bracket on the timber 12. Because of the angular orientation of the lag foot 20, weight upon the cantilever leg 16 torsionally locks the plank bracket on the timber. The bearing roller 36 comprises a freewheel assembly shown in the exploded view of FIG. 3 and includes a roller 40 having a knurled or gear-like outer surface 42 to increase the coefficient of friction and a sawtooth twelve-point inner surface 44 that rotates on a cast journal 46 having a pair of grooves 48 in which ride a pair of gravity-located ball bearings. In this arrangement the roller 40 is free to rotate on the journal 46 in only one direction. The freewheel assembly is designed to allow the roller to roll when the bracket 10 is moved in the upward direction but lock in the downward direction. The case journal 46 is fastened to the toe 38 of the lag foot 20 by a bolt 50 and includes a projecting ear 52 which hooks around the timber 12 as shown in FIG. 2.

Similarly, a portion of the mounting face 26 of the T-section bearing heel 22 provides a locking ear 54 that hooks around the timber 12 and cooperates with the ear 52 on the lag foot 20 to collar the timber 12 and prevent side slip or disengagement of the bracket from the timber. The distance between the respective ears 52 and 54 is sufficiently greater than the width of the timber to allow for initial installation of the plank bracket on the timber when the foot is horizontally oriented.

Referring again to FIG. 1, a spring loaded clamping mechanism designated generally by the reference numeral 56, insures that the bracket is locked on the supporting timber 12. The clamping mechanism 56 includes an elongated rod 58 guided adjacent the web portion of the bracket casting through a guide hole (not visible) in the base portion 18 of the bracket casting and a guide hole (not visible) in a trunnion 60 fixed to the web portion 62 of the bracket casting. The rod 58 extends from the bracket leg 16 and terminates in a handle 64. At the opposite end of the rod between the trunnion 60 and an E-clip and washer 66 is a compression spring 68 which compresses when the handle 64 and rod 58 are drawn from the bracket leg 16. The handle 64 and rod are rotatable in the guide holes. The handle includes a flat clamping face 70 and retaining ear 72 such that when the handle and rod are withdrawn as shown in FIG. 1, it can be rotated 90 degrees and relaxed to a release point with the clamping face 70 pressing against the timber and the ear 72 preventing disengagement as shown in FIG. 2. It is evident that the clamping action of the clamping mechanism locks the bracket in place on the timber.

While the bracket may be moved up and down on the timber by direct manual manipulation in first releasing the clamping force by drawing back the handle and then lifting the bracket to raise, or then tilting the bracket to displace slightly the one-way roller from the timber to lower, the plank bracket may be raised or lowered remotely.

Since it is often the case that the bracket cannot be directly raised or lowered because of its inaccessible height, a means has been devised to raise or lower the bracket from above, or from the ground by a common hoisting rope 74. With additional reference to FIGS. 4(*a*), 4(*b*), and 5, a short cable 76 of predetermined length is anchored by a cable ferrule 78 in a protruding boss 80 in the base portion 18 of the bracket. The cable 76 passes behind the rod 58, around pulley 81, upwardly through a hole 82 and vertically to a ring terminal 84 which can be connected to the hoisting rope 74 by a clip 86 on the rope.

Figure 4B:
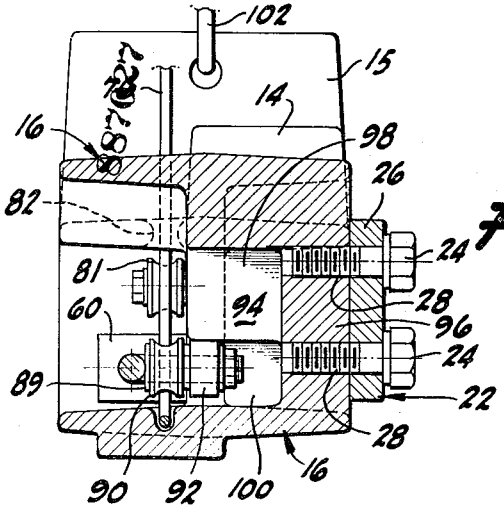
FIG. 4(*a*) is a cross sectional view taken on the lines 4(*a*)—4(*a*) in FIG. 1.
Figure 4A:
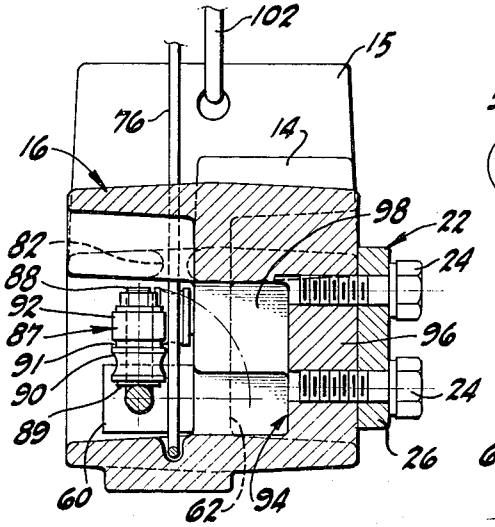

On the rod 58 in the area of the cable passage across the leg of the bracket, is a projecting roller and pulley assembly 87 comprising a shaft 88 welded to the rod normal to the axis of the rod, a washer 89, a small pulley 90 mounted on the shaft 88 adjacent the washer 89, a second washer 91, a small roller 92 mounted on the shaft adjacent the second washer 91, and a self-locking nut 93. In the web portion 62 of the bracket leg 16 is a recess 94. As shown in FIGS. 4(*a*) and 4(*b*), the recess 94 does not completely go through the web portion 62 because of a thickening ramp 96 at the end of the web portion on one side of the bracket as shown in FIG. 2.

In the position of the handle and rod shown in FIG. 1, the roller and pulley assembly is aligned with a turn key portion 98 of the recess 94. In this position, it is possible to rotate the handle pivoting the roller and pulley assembly into the turn key portion 98 as shown in FIGS. 4(*a*) and 4(*b*) such that the roller 92 is movable in a guide way portion 100 of the cutout. In this position, the pulley 90 begins to interfere with the cable. As the handle and rod is relaxed into clamping position, the pulley 90 draws back the cable as shown in FIG. 5. When the hoist rope is pulled, the cable tautens by the weight of the bracket and by action on the pulley, forces the rod slightly in a retracted direction thereby releasing the clamping force at the handle on the timber. The roller 92 contacts the upper wall of the guide way portion and prevents rotation of the rod. In this manner the bracket can be lifted.

To lower, not only must the clamping action be relieved, but the brackets must be tilted as mentioned before. This is accomplished by a cable segment 102 which is permanently fastened to the distal plank stop 15. The cable segment is of a predetermined length such that when attached to the main cable ring 84, it shifts the direction of tension sufficiently to cause a tilt or cant to the plank bracket without interfering with the releasing capability of the main cable and the roller and pulley assembly. This cant is necessary to disengage the one-way bearing roller 36 from the edge of the timber and remove the "bite" from the heel bearing 22 such that the bearing face 30 is flush with the edge of the timber and guides the plank bracket as it is lowered. By simple use of a pulley or simply a capstan post at the top of the structure under construction, the hoist rope can be manipulated from the ground.

While the plank bracket comprises the principal element in the scaffold hardware, it is advantageously used with additional hardware to facilitate erection of scaffolding.

Figure 6:
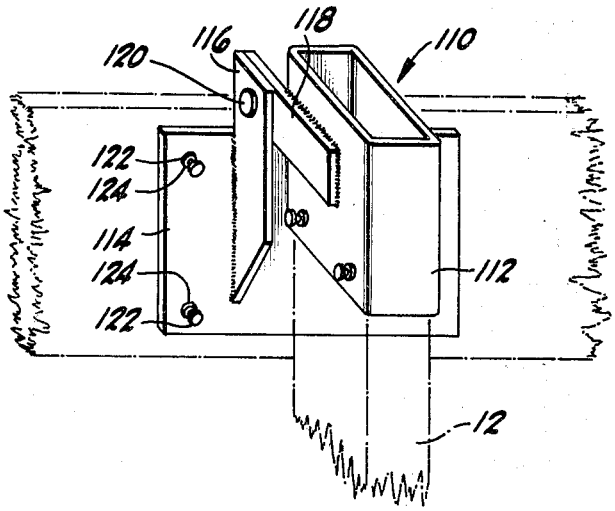
FIG. 6 is a perspective view of a support hardware.

Referring now to FIG. 6, a collar assembly is shown for support of the timber 12. It is preferred that the timber used for the bracket assembly comprise a conventional two by six plank. However, use of a three by six of four by six is possible with adaptors for the roller and heel bearing and a substitute handle. In using the preferred timber stock, the collar assembly is provided with a rectangular tube section 112 dimensioned compatible with the cross sectional dimensions of the two by six such that the collar assembly is snug but free to slide along the length of the two by six. The tube section 112 is pivotally connected to a mounting plate 114 by a pair of connecting links 116 and 118 and pin 120. The mounting plate 114 can be directly fastened to the facia of a structure by duplex nails 122 through pre-existing holes 124 in the plate. Alternately the plate because of its pivotal nature can be fastened to a horizontal outrigger element tied off to the structure by raising the plate to a horizontal position, or fastened to a downwardly sloped member attached to a pitched roof by again adjusting the position of the mounting plate.

The collar assembly positions the timber vertically without inhibiting longitudinal movement where most stresses are usually generated as the scaffolding settles at its footing.

Figure 7:
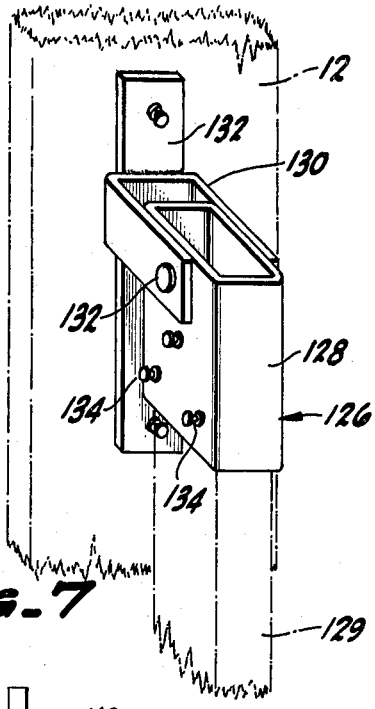
FIG. 7 is a perspective view of a bracing hardware.

In FIG. 7, a brace socket 126 is shown. The brace socket 126 includes a rectangular tube section 128 dimensioned to receive the end of a two by four brace 129 segment as shown in phantom. The tube section 128 is pivotally attached to a yoke 130 by pivot pin 132. The yoke 130 is rigidly connected to a mounting plate 132 which is fastened to the face of the timber 12. The brace socket is centrally mounted on the timber face to allow the bracket to pass up and down the timber without the projecting ears on the plank bracket contacting the brace socket. The two by four is retained in the socket and the mounting plate is mounted on the timber 12 by duplex nails 134 in pre-existing holes.

Figure 8:
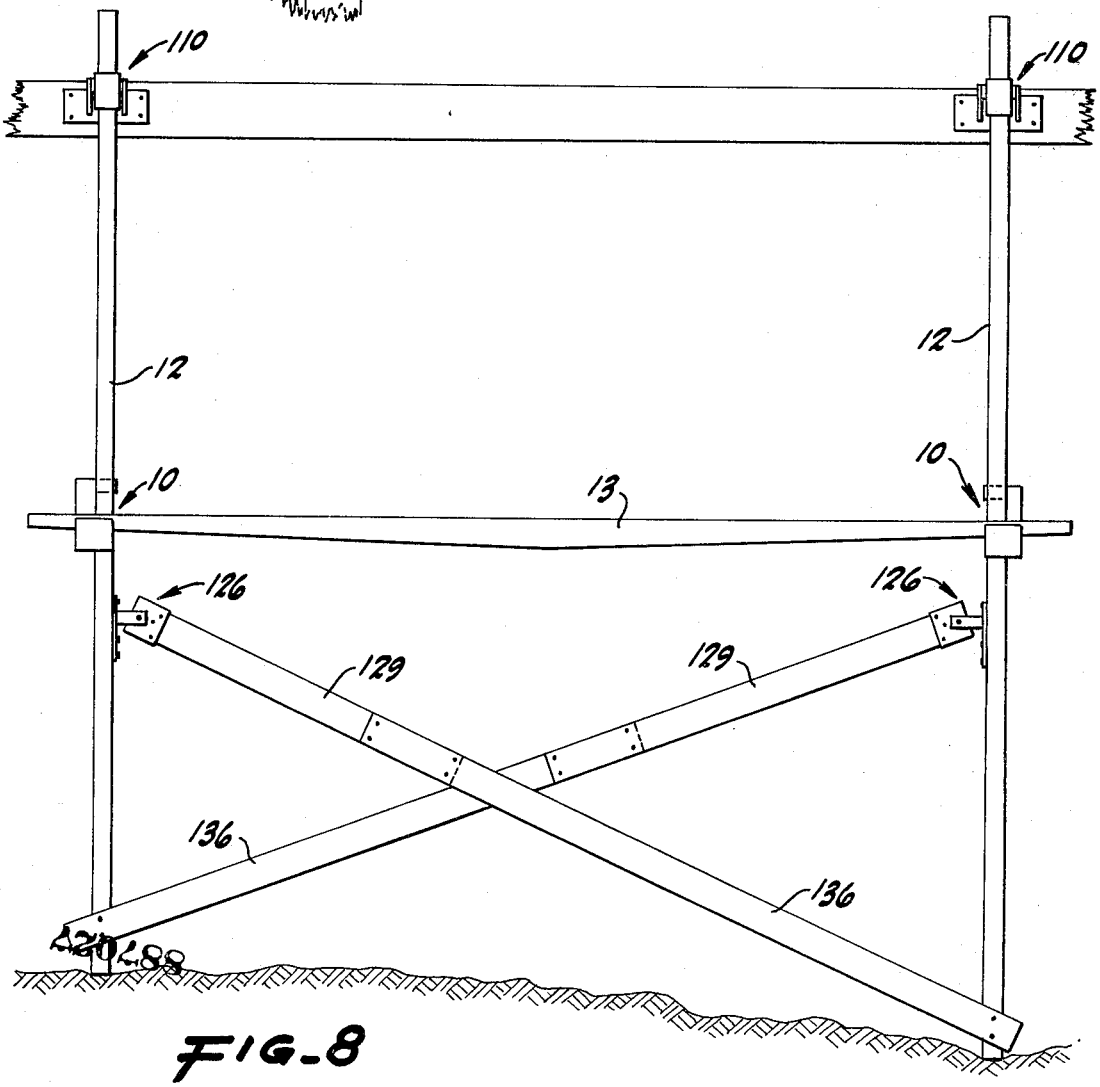
FIG. 8 is a schematic view of the scaffold apparatus.

The manner of assembly of the scaffolding is described with reference to the schematic illustration of FIG. 8. A pair of brace sockets 126 are attached to each timber. Brace segments 129, preferably no longer than the timber height to the brace sockets, are installed and left loose against the timber. A collar assembly 110 is slipped over the end of each timber and retained temporarily by a removable rail. The plank brackets may be installed at this time or after raising the timbers. The timbers are raised, the nail removed and the mounting plates attached to appropriate structures. A second brace segment 136 is fastened to the foot of each timber by a single duplex nail and laid horizontally on the ground. The brace segment 129 in the hinged socket on one timber is joined with the brace segment 136 attached to the foot of the opposite timber by raising the free ends of both segments and nailing in a straight line diagonal. One or more additional nails are placed in the foot connection to firm up the bracing. The plank brackets are installed, a banana board placed on the brackets and the brackets raised to an appropriate height in the manner described. The brackets may be installed such that the plank brackets and working plank either face the building or face away from the building depending on the available space for the timber and the attachment point to the structure.

As noted the two brackets are a mirror image of one another or an isomeric duplication such that the lag foot of each bracket is on the outer side of the two parallel spaced timbers. In this manner the two brackets will avoid contact with the hardware for the cross bracing. The two brackets, together with two collar assemblies, and two brace sockets are intended to be provided in kit form to the user. Timber for the vertical members and cross bracing is intended to be utilized from the job site or obtained separately.

I claim:

1. A support bracket usable in pairs for supporting a working plank or scaffolding adapted for attachment to a vertical structural scaffold member that comprises a conventional timber member with side faces and fore and aft edges comprising:

a bracket member attachable to a vertical timber member having:

a. a base portion with a bearing means for contacting the fore edge of the timber member;

b. a leg member extending substantially horizontally from said base portion away from the fore edge of the timber member adapted to support one end of a working plank;

c. a foot member extending at an upward angle from horizontal in a generally opposite direction from said leg member and adjacent the side face of the timber member, said foot member having a bearing means for contacting the aft edge of the timber member;

d. clamping means for exerting a clamping force against the aft edge of the timber member directed substantially at said bearing means of said base portion, wherein said clamping means is spring loaded and selectively releasable and includes a handle for manual release of the clamping force against the aft edge of the timber member.

2. A support bracket usable in pairs for supporting a working plank or scaffolding adapted for attachment to a vertical structural scaffold member that comprises a conventional timber member with side faces and fore and aft edges comprising:

a bracket member attachable to a vertical timber member having:

a. a base portion with a bearing means for contacting the fore edge of the timber member;

b. a leg member extending substantially horizontally from said base portion away from the fore edge of the timber member adapted to support one end of a working plank;

c. a foot member extending at an upward angle from horizontal in a generally opposite direction from said leg member and adjacent the side face of the timber member, said foot member having a bearing means for contacting the aft edge of the timber member;

d. clamping means for exerting a clamping force against the aft edge of the timber member directed substantially at said bearing means of said base portion, wherein said clamping means is spring loaded and selectively releasable, and includes means for remotely removing the clamping force against the aft edge of the timber member.

3. The support bracket of claim 2 where said means for remotely removing the clamping force comprises an elongated extension element, a bearing element connected to said extension element, said bearing element adapted to contact the aft edge of the timber member, a spring element, means for supporting said extension element on said bracket member in conjunction with said spring element with said bearing element extending from said base portion in forced contact with the aft edge of the timber member, activating means for activating a displacement of said extension element, and means for remotely activating said activating means.

4. The support bracket of claim 3 wherein said activating means comprises a bearing device on said extension element, and said means for remotely activating said activating means comprises a cable connected to said bracket member.

5. The support bracket of claim 4 wherein said leg member has a distal end and said clamping means includes means for remotely lowering said bracket member, said means including a cable segment connectable to said distal end of said leg member and attached to said cable above said bracket member a distance that shifts the point of lift and displaces said bearing means for contacting the aft edge of the timber from the timber member.

6. The support bracket of claim 4 wherein said bearing device on said extension element is engageable with said cable and said cable has one end anchored to said bracket member.

7. The support bracket of claim 6 wherein said bearing device comprises a pulley means rotatably connected to said extension element and includes a roller, said base portion of said bracket member having a roller guide, said roller engageable with said roller guide and displaceable with respect thereto, and a pulley engageable with said cable and displaceable by said cable when tension is exerted on said cable wherein displacement of said pulley displaces said extension element.

8. The support bracket of claim 7 wherein said roller guide comprises a cut-out of said base portion of said bracket member, said pulley and said roller including a common pivot element attached to said extension element and said cut-out having a key slot portion for insertion of said roller in said roller guide on partial rotation of said extension element, said extension element being partially rotatably to engage said bearing element with the aft edge of the timber member.

9. The support bracket of claim 2 wherein said clamping means includes further means for remotely lowering said bracket member.

10. A support bracket of claim 9 wherein said lowering means includes means for tilting said bracket member to a degree that said bearing means on said foot member becomes disengaged with the timber member.

11. The support bracket of claim 2 in combination with support hardware means for vertically supporting said timber member to a building structure, said support hardware means including a slidable collar adapted to collar a top portion of the timber member, said collar having a hinged connection to a mounting plate.

12. The support bracket of claim 11 wherein said mounting plate has means for attachment of said mounting plate to a building which includes a structural member connected to said mounting plate said structural member being adapted for connection to a building structure.

13. The support bracket of claim 2 in combination with bracing hardware means for bracing the timber member, comprising a first timber member and a similar second timber member, the bracing hardware including a socket element adapted to receive a structural element means for connecting said first timber member to said second timber member, and a mounting plate hingedly connected to said socket element, said mounting plate having means for attachment to a side face of the first timber member without interfering with movement of said support bracket on the timber member.

14. The support bracket of claim 13 in further combination with a isomeric duplication of said support bracket, a second bracing hardware means and two support hardware means for vertically supporting timber members to a building structure, each of said support hardware means including a slidable collar adapted to collar a top portion of a timber member, said collar having a hinged connection to a mounting plate said mounting plate, said two support brackets, two bracing hardware means and two support hardware means comprising a scaffolding hardware kit.

15. A support bracket usable in pairs for supporting a working plank or scaffolding adapted for attachment to a vertical structural scaffold member that comprises a conventional timber member with side faces and fore and aft edges comprising:

a bracket member attachable to a vertical timber member having:

a. a base portion with a bearing means for contacting the fore edge of the timber member;

b. a leg member extending substantially horizontally from said base portion away from the fore edge of the timber member adapted to support one end of a working plank;

c. a foot member extending at an upward angle from horizontal in a generally opposite direction from said leg member and adjacent the side face of the timber member, said foot member having a bearing means for contacting the aft edge of the timber member, wherein said bearing means of said foot member comprises a roller assembly comprising a freewheel with a friction surface with means for allowing rotation when said bracket member is raised and preventing rotation when said bracket member is lowered when said roller assembly is in contact with the aft edge of the timber member;

d. clamping means for exerting a clamping force against the aft edge of the timber member directed substantially at said bearing means of said base portion.

16. A support bracket usable in pairs for supporting a working plank or scaffolding adapted for attachment to a vertical structural scaffold member that comprises a conventional timber member with side faces and fore and aft edges comprising:

a bracket member attachable to a vertical timber member having:

a. a base portion with a bearing means for contacting the fore edge of the timber member;

b. a leg member extending substantially horizontally from said base portion away from the fore edge of the timber member adapted to support one end of a working plank;

c. a foot member extending at an upward angle from horizontal in a generally opposite direction from said leg member and adjacent the side face of the timber member, said foot member having a bearing means for contacting the aft edge of the timber member;

d. clamping means for exerting a clamping force against the aft edge of the timber member opposite said bearing means of said base portion, wherein said bearing means of said base portion comprises a plate element with a bearing face and a bottom outside edge, said bearing face being oriented at a slight angle to the vertical and said bottom outside edge being biased toward the fore edge of the timber member to provide a bite to inhibit downward movement of said bracket member on the timber member when said bracket member is set with said bearing means of said foot member in contact with the aft edge of the timber member.

17. The support bracket of claim 16 wherein said base portion of said bracket member includes locating means for orienting said plate element.

* * * * *